US011827428B2

(12) United States Patent
Zwaga et al.

(10) Patent No.: US 11,827,428 B2
(45) Date of Patent: Nov. 28, 2023

(54) CLAMSHELL PACKAGING FOR AIRTIGHT PACKAGING OF FOODSTUFF

(71) Applicant: Packable B.V., Almelo (NL)

(72) Inventors: Ronald Zwaga, Almelo (NL); Gerrit Arie Buis, Enter (NL); Alain Wietse Bastiaan Tasma, Notter (NL); Remi De Olde, Almelo (NL)

(73) Assignee: Packable B.V., Almelo (NL)

( * ) Notice: Subject to any disclaimer, the term of this patent is extended or adjusted under 35 U.S.C. 154(b) by 120 days.

(21) Appl. No.: 17/047,556

(22) PCT Filed: Apr. 11, 2019

(86) PCT No.: PCT/EP2019/059297
§ 371 (c)(1),
(2) Date: Oct. 14, 2020

(87) PCT Pub. No.: WO2019/201746
PCT Pub. Date: Oct. 24, 2019

(65) Prior Publication Data

US 2021/0155362 A1 May 27, 2021

(30) Foreign Application Priority Data

Apr. 18, 2018 (EP) ..... 18167996

(51) Int. Cl.
*B65D 5/00* (2006.01)
*B31B 50/64* (2017.01)
(Continued)

(52) U.S. Cl.
CPC ..... *B65D 5/0085* (2013.01); *B31B 50/592* (2018.05); *B31B 50/64* (2017.08);
(Continued)

(58) Field of Classification Search
CPC ..... B65D 5/667; B65D 5/563; B65D 5/0085; B65D 5/243; A47G 19/03; A47G 21/001
(Continued)

(56) References Cited

U.S. PATENT DOCUMENTS 4,241,863 A * 12/1980 Faller ..... B65D 77/00 229/120.09
4,266,713 A * 5/1981 Maroszek ..... B65D 5/6626 229/164
(Continued)

FOREIGN PATENT DOCUMENTS

EP 0419068 A2 3/1991
EP 2441696 A1 4/2012
(Continued)

*Primary Examiner* — Christopher R Demeree
(74) *Attorney, Agent, or Firm* — THE WEBB LAW FIRM

(57) ABSTRACT

A clamshell packaging for airtight packaging of foodstuff includes a tray folded out of a single sheet. The tray has at least two adjacent pool parts, each pool part having a bottom wall and upstanding walls arranged around the circumferential edge of the bottom wall. The adjacent pool parts are hingedly connected to each other along an upper edge of a respective upstanding wall, so the adjacent pool parts can be hinged on top of each other to form a closed box. A circumferential, horizontal flange is arranged to the tray to at least some upper edges of the upstanding walls. A plastic barrier foil is arranged in the pool parts and extends onto and substantially covers the flange. The flange includes a seal zone extending along the length of the flange. The seal zone is line symmetrical along the hinge line at the upper edge of the connected walls.

19 Claims, 7 Drawing Sheets

(51) Int. Cl.

| | |
|---|---|
| ***B31B 50/59*** | (2017.01) |
| ***B65D 5/56*** | (2006.01) |
| ***B65D 5/66*** | (2006.01) |
| ***B31B 120/40*** | (2017.01) |
| ***B31B 110/10*** | (2017.01) |
| ***B31B 120/10*** | (2017.01) |

(52) U.S. Cl.
CPC ..... *B65D 5/563* (2013.01); *B65D 5/667* (2013.01); *B31B 2110/10* (2017.08); *B31B 2120/102* (2017.08); *B31B 2120/404* (2017.08)

(58) Field of Classification Search
USPC ..... 229/245, 114, 906, 125.35, 902, 232, 229/125.08, 132
See application file for complete search history.

(56) References Cited

U.S. PATENT DOCUMENTS

| | | | | | |
|---|---|---|---|---|---|
| 4,792,085 | A * | 12/1988 | Waring, III | B65D 5/6626 | 229/920 |
| 5,009,939 | A | 4/1991 | Goldberg | | |
| 5,205,476 | A * | 4/1993 | Sorenson | B65D 5/667 | 229/148 |
| 5,221,040 | A * | 6/1993 | Sorenson | B65D 5/667 | 229/148 |
| 5,332,147 | A * | 7/1994 | Sorenson | B65D 5/6626 | 229/148 |
| 5,356,070 | A | 10/1994 | Rigby | | |
| 5,388,758 | A * | 2/1995 | Scovell | B65D 5/667 | 229/920 |
| 5,553,772 | A * | 9/1996 | Jensen | B65D 5/667 | 229/148 |
| 5,735,454 | A | 4/1998 | Jensen | | |
| 8,733,626 | B2 * | 5/2014 | Learn | B65D 5/667 | 229/145 |
| 9,540,135 | B2 * | 1/2017 | Robertson | B65D 5/667 | |
| 10,647,466 | B2 | 5/2020 | Zwaga et al. | | |
| 10,829,266 | B2 * | 11/2020 | Zeiler | B65D 5/4266 | |

FOREIGN PATENT DOCUMENTS

| | | | |
|---|---|---|---|
| EP | 2441697 | A1 | 4/2012 |
| JP | 20012056 | A | 1/2001 |

* cited by examiner

CLAMSHELL PACKAGING FOR AIRTIGHT PACKAGING OF FOODSTUFF

CROSS-REFERENCE TO RELATED APPLICATIONS

This application is the United States national phase of International Application No. PCT/EP2019/059297 filed Apr. 11, 2019, and claims priority to European Patent Application No. 18167996.0 filed Apr. 18, 2018, the disclosures of which are hereby incorporated by reference in their entirety.

BACKGROUND OF THE INVENTION

Field of the Invention

The invention relates to a clamshell packaging for airtight packaging of foodstuff, which packaging comprises:

- a tray folded out of a single sheet of material, preferably cardboard, which tray has at least two adjacent pool parts, each pool part having a bottom wall and upstanding walls arranged around the circumferential edge of the bottom wall,
- wherein the at least two adjacent pool parts are hingedly connected to each other along an upper edge of a respective upstanding wall, such that the at least two adjacent pool parts can be hinged on top of each other to form a closed box,
- a circumferential, horizontal flange arranged to the tray to at least some of the upper edges of the upstanding walls, and
- a plastic barrier foil arranged in the pool parts and extending onto and substantially covering the circumferential, horizontal flange.

Description of Related Art

Such a clamshell packaging is known from U.S. Pat. No. 5,356,070.

U.S. Pat. No. 5,356,070 discloses a tray with two or more pool parts, which tray is provided with a plastic layer by blow molding. The plastic layer is foremost used to keep the cardboard wall parts together, such that the tray maintains its folded erected state. According to the publication, a top seal foil can be arranged on the flange of the tray to airtight seal the tray.

U.S. Pat. No. 5,356,070 furthermore suggests that if the pool parts are made identical, a clamshell packaging is provided. However, the publication does not disclose how to close such a clamshell packaging such that an airtight packaging for foodstuff is provided. It therefore appears that the publication suggests an alternative for the typical hamburger packaging, which is solely made out of cardboard. Such a hamburger packaging is a folded sheet of cardboard providing a clamshell packaging, which is only intended for keeping the hamburger warm for a small amount of time. Such a cardboard packaging is not air tight and not suitable to keep the hamburger fresh for a number of days.

SUMMARY OF THE INVENTION

It is an object of the invention to provide a clamshell packaging, which is suitable for airtight packaging of foodstuff.

This object is achieved with a clamshell packaging according to the preamble, which is characterized in that the circumferential, horizontal flange comprises a seal zone extending along the full length of the flange, wherein the seal zone is line symmetrical along the hinge line at the upper edge of the connected walls.

By providing a line symmetrical seal zone, the clamshell packaging can be sealed closed after the at least two adjacent pool parts are hinged on top of each other to form a closed box. The seal zones on both sides of the hinge line will overlap with each other, such that the seal zone is in direct contact with itself, allowing for an air tight seal along the circumferential, horizontal flange. As the plastic barrier foil is arranged in the pool parts and extends onto and substantially covering the circumferential, horizontal flange, the sealing of the seal zone provides an air tight space enclosed by the plastic barrier foil and the tray folded to a closed box.

By sealing the seal zones on both sides of the hinge line together a strong box is provided, which allows for the sheet material thickness to be reduced, reducing the costs of the clamshell packaging.

In a preferred embodiment of the clamshell packaging according to the invention, the circumferential, horizontal flange is composed out of a number of abutting flange parts, each flange part being arranged to a respective upper edge of an upstanding wall, and wherein each of the transitions of two abutting edges of the flange parts are positioned line asymmetrically along the hinge line, such that none of the transitions overlap with each other when the at least two adjacent pool parts are hinged on top of each other.

Abutting in the context of this inventions means without overlapping parts. So when two flange parts abut, the flange parts are only in contact with each other along respective edges and not by an edge of one flange part in contact with a surface of another flange part.

By composing the circumferential flange out of a number of abutting flange parts, the tray can easily be folded out of an unfolded sheet of cardboard. Having the transitions of two abutting edges of the flange parts positioned asymmetrically, it is ensured that when folding the pool parts on top of each other none of the transitions overlap. So each transition will abut against a flange part and when sealing the sealing zones together, the sealing at the transition will be substantially more reliable, then when two transitions overlap. In this latter case, when sealing two overlapping transitions, the chance is considerable that a channel will remain present along the transitions, such that the packaging is not air tight sealed.

In a further embodiment of the clamshell packaging according to the invention the circumferential, horizontal flange is provided with two tabs, each arranged on opposite sides of the hinge line and line asymmetrically along the hinge line, and preferably on the same side of the tray.

The two tabs provide a grip for a user to tear two sealed pool parts from each other to open an air tight sealed packaging.

Preferably, the difference in distance to the hinge line of the two tabs is at least equal to half of the combined length of the two tabs. This ensures that the tabs do not overlap when the at least two adjacent pool parts can be hinged on top of each other to form a closed box and provides maximum gripping space for the user.

In a further preferred embodiment of the clamshell packaging according to the invention, the plastic barrier foil is a laminate of at least a skin foil layer and a release medium layer, wherein the skin foil layer is in direct contact with tray.

This laminate allows for a good adherence to the walls of the tray, while the release medium layer allows for good sealing properties when brought into contact with itself at the seal zone and for easy opening of the packaging, which is called in the field "easy peel".

In prior art, such as known from EP 2441697, the release medium layer will be arranged on the top seal foil and not to the skin foil, which is laminated into the tray. Also with the prior art U.S. Pat. No. 5,356,070, a release medium layer would not be possible to be arranged due to the blow molding technique.

The materials used for the skin foil layer and the release medium layer are common general knowledge for a person skilled in the art.

In yet another embodiment of the clamshell packaging according to the invention, the tray is provided with a slot arranged in the connected upstanding walls along the hinge line. When the foil is arranged over the connected upstanding walls and the two adjacent pool parts are hinged on top of each other to form a closed box, the foil is pressed together at the hinge and could force the connected upstanding walls inwardly. By arranging the slot along the hinge line, additional space is provided for the foil such that the foil is less compressed at the hinge and the connected upstanding walls are not urged inwardly.

In still a further preferred embodiment of the clamshell packaging according to the invention the circumferential, horizontal flange is wider adjacent to a first pool part than adjacent to a second pool part.

When the two pool parts are hinged on top of each other the wider portion of the horizontal flange will cover the smaller portion of the horizontal flange, such that any small misalignment is not directly visible for a consumer.

It is furthermore preferred if the folding line between the horizontal flange and the adjacent upright walls is provided such, that the horizontal flange folds back up a bit, such that the pool parts, when hinged on top of each other, are slightly spaced apart. This allows for gassing the packaging just before sealing the packaging closed. Furthermore, the horizontal flange will be in good contact with itself upon sealing, because the folding line is arranged such, that the flange folds back up a bit.

To achieve the effect of the flange folding back up a bit, a suitable perforation or scoreline can be provided at the folding line.

The invention also relates to a device for sealing a clamshell packaging according to the invention, wherein two adjacent pool parts are hinged on top of each other to form a closed box, which device comprises:

- a mold for accommodating a first pool part of the tray with the horizontal circumferential flange on the upper surface of the mold;
- a heated frame movable on top of the upper surface, wherein inner dimensions of the frame correspond to the inner dimensions of the horizontal, circumferential flange, such that a second pool part can extend through the frame, while the horizontal, circumferential flange is clamped between the mold and the frame to seal the seal zone together.

As a sealed clamshell packaging is already strong by itself, the sheet material thickness can be reduced, such that sealing of the seal zone together by feeding heat through the sheet material of the flange into the seal zone of the foil in order to seal the seal zone together is quicker.

The invention furthermore relates to a method for providing a clamshell packaging according to the invention, which method comprises the steps of:

- providing an unfolded sheet for folding a tray;
- providing a mold having at least two recesses;
- folding the unfolded sheet to a tray by pressing the unfolded sheet into the mold, wherein the tray has at least two pool parts, each pool part having a bottom wall and upstanding walls arranged around the circumferential edge of the bottom wall, which pool parts are each accommodated in a recess of the mold, and a horizontal, circumferential flange composed out of a number of flange parts, each flange part being arranged to a respective upper edge of an upstanding wall of the pool parts, which flange parts compose an endless circumferential flange and wherein adjacent wall parts and adjacent flange parts of the pool parts abut;
- providing a plastic barrier foil;
- heating the plastic barrier foil;
- pressing the heated plastic barrier foil against the inner wall of the two pool parts and covering the circumferential flange, such that the plastic barrier foil is laminated to the tray.

A similar method is known from EP 2441697 of the same applicant. This known method does not disclose the provision of a mold having two recesses and the folding of an unfolded sheet into a tray according to the invention.

Preferably, the bottom walls of the pool parts are pushed towards each other, while pressing the unfolded sheet into the mold. By pushing the bottom walls of the pool parts together, the connected walls of the two pool parts are folded towards the desired position.

An embodiment of the method according to the invention further provides two shape blocks each to act at least on a bottom wall of a respective pool part to shape the unfolded sheet while pressing the unfolded sheet into the mold.

In a preferred embodiment of the method according to the invention the two shape blocks are each guided along a guide arranged under an angle with the top surface of the mold, such that the two shape blocks move towards each other, while being moved into the mold to fold the unfolded sheet.

In another preferred embodiment of the method according to the invention the two shape blocks are guided along a first guide parallel to the top surface of the mold and are guided along a second guide perpendicular to the top surface of the mold, wherein the shape blocks first move along the first guide to fold the connected wall parts of both pool parts and then the shape blocks move along the second guide to fold the sheet into the mold.

These and other features of the invention will be elucidated in conjunction with the accompanying drawings.

DETAILED DESCRIPTION OF THE INVENTION

Figure 1:
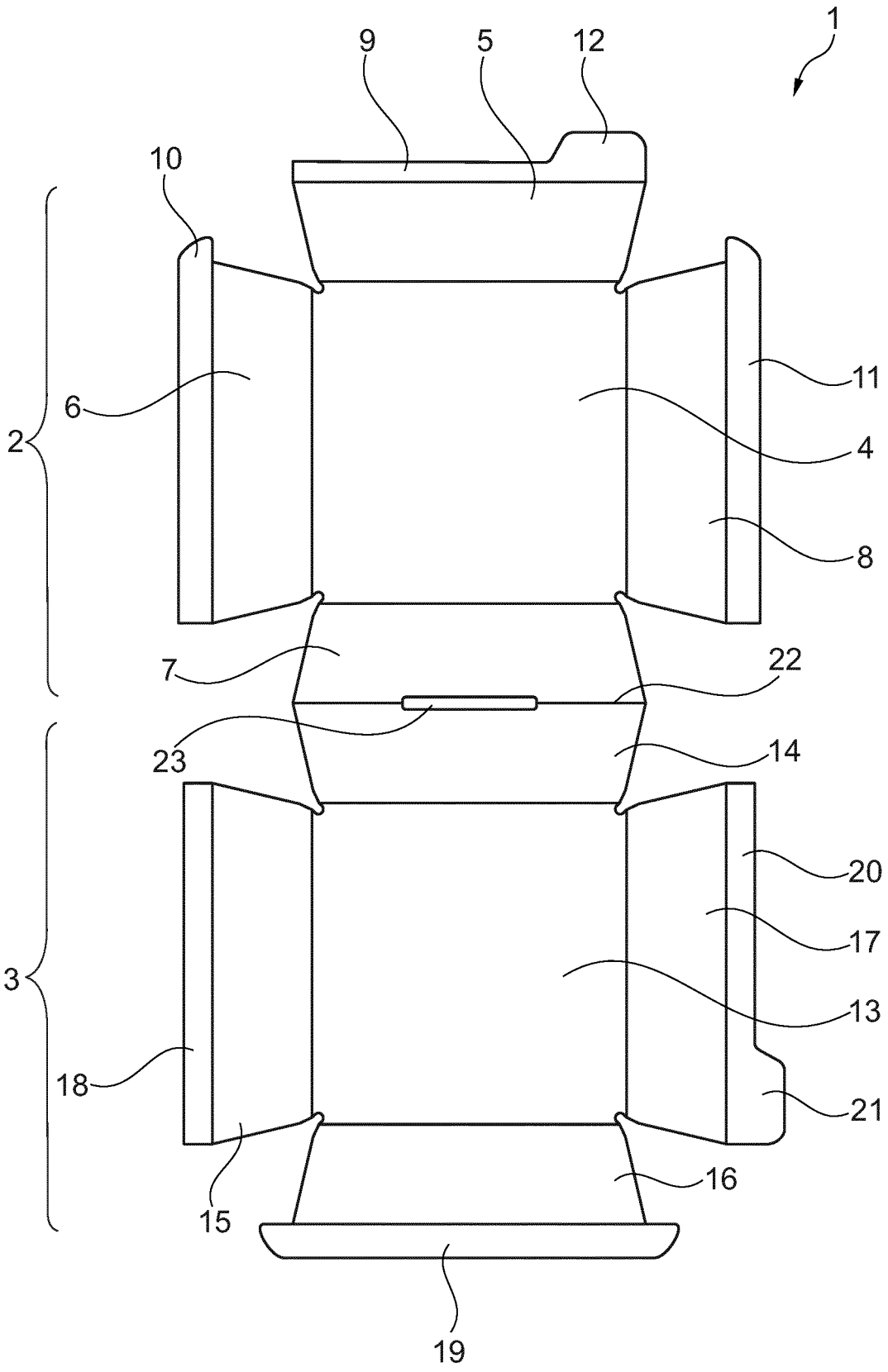
FIG. 1 shows a top view of an unfolded sheet for a clamshell packaging according to the invention.

FIG. 1 shows a top view of an unfolded sheet 1 for a clamshell packaging according to the invention. The unfolded sheet 1 has a first pool part 2 and a second pool part 3. The first pool part 2 has a bottom wall 4 and upstanding walls 5, 6, 7, 8 arranged around the circumferential edge of the bottom wall 4. The upstanding walls 5, 6, 8 have at its respective upper edge a flange part 9, 10, 11. The flange part 11 is furthermore provided with a tab 12.

The second pool part 3 has a bottom wall 13 with upstanding walls 14, 15, 16, 17 around the circumferential edge. The upstanding walls 15, 16, 17 are provided with flange parts 18, 19, 20, where flange part 20 is provided with a tab 21.

The wall parts 7 and 14 are connected to each other along the upper edge 22, which is provided with a slot 23.

Figure 2:
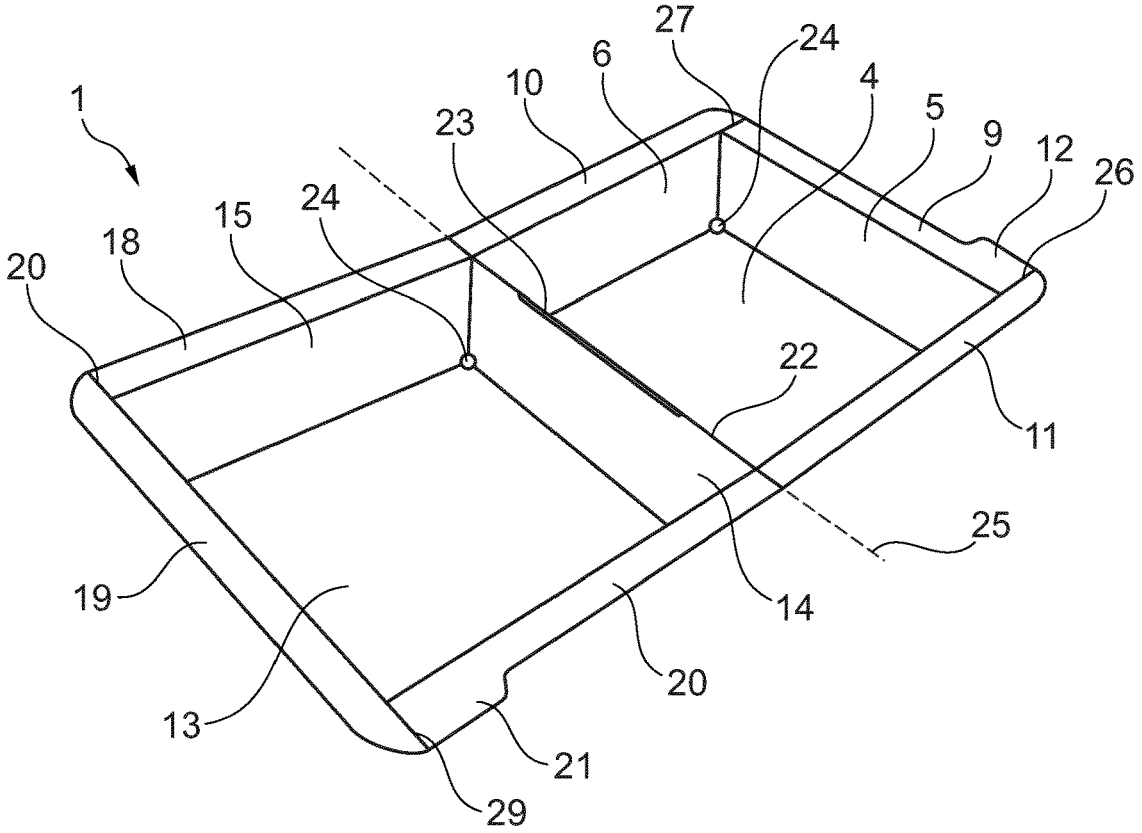
FIG. 2 shows the unfolded sheet of FIG. 1 folded to a clamshell packaging.

FIG. 2 shows the unfolded sheet 1 of FIG. 1 folded to a clamshell packaging.

The walls 5, 6, 7, 8 of the first pool part 2 and the walls 14, 15, 16, 17 of the second pool part 3 are folded up, such that the edges of adjacent walls abut, i.e. that the edges touch each other. The respective flange parts 9, 10, 11, 18, 19, 20 are also folded such that adjacent flange parts 9, 10, 11, 18, 19, 20 abut and form a circumferential, horizontal flange along the tray formed by the two pool parts 2, 3.

The folded sheet 1 is kept in folded position by laminating a plastic foil to the inside of the pool parts 2, 3 and covering the circumferential, horizontal flange. The lamination can be done in a similar way as described in the European patent no. 2441697 of the applicant. To this end, suction holes 24 are provided, although not essential, which improve the pressing of the foil into the folded sheet by creating an underpressure between the foil and the folded sheet.

Figure 3:
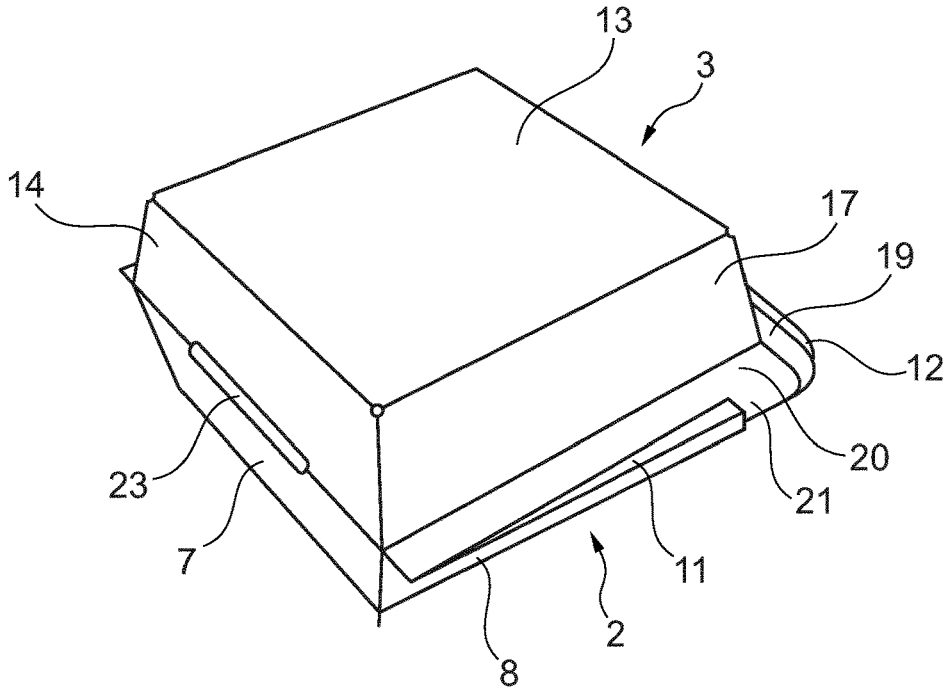
FIG. 3 shows the packaging according to FIG. 2 folded closed.

The upstanding walls 7, 14, which are connected to each other at the upper edge 22 provide a hinge line 25 around which the second pool part 3 can be hinged on top of the second pool part, as shown in FIG. 3.

The hinge line 25 also provide a line of symmetry for the flange parts 9, 10, 11, 18, 19, 20 which form the seal zone. The seal zone does not include the tabs 12, 21 as they are not symmetrically arranged relative to the hinge line 25.

The abutting edges of the flange parts 9, 10, 11, 18, 19, 20 provide transitions 26, 27, 28, 29, where the foil bridges from one flange part to the other, adjacent flange part.

The transitions 26, 27 are arranged perpendicular to the hinge line 25, whereas the transitions 28, 29 are arranged parallel to the hinge line 25, such that the transitions 26, 27, 28, 29 are arranged asymmetrically along the hinge line 25 and will not overlap when the second pool part 3 is hinged on top of the second pool part, as shown in FIG. 3.

Figure 4:
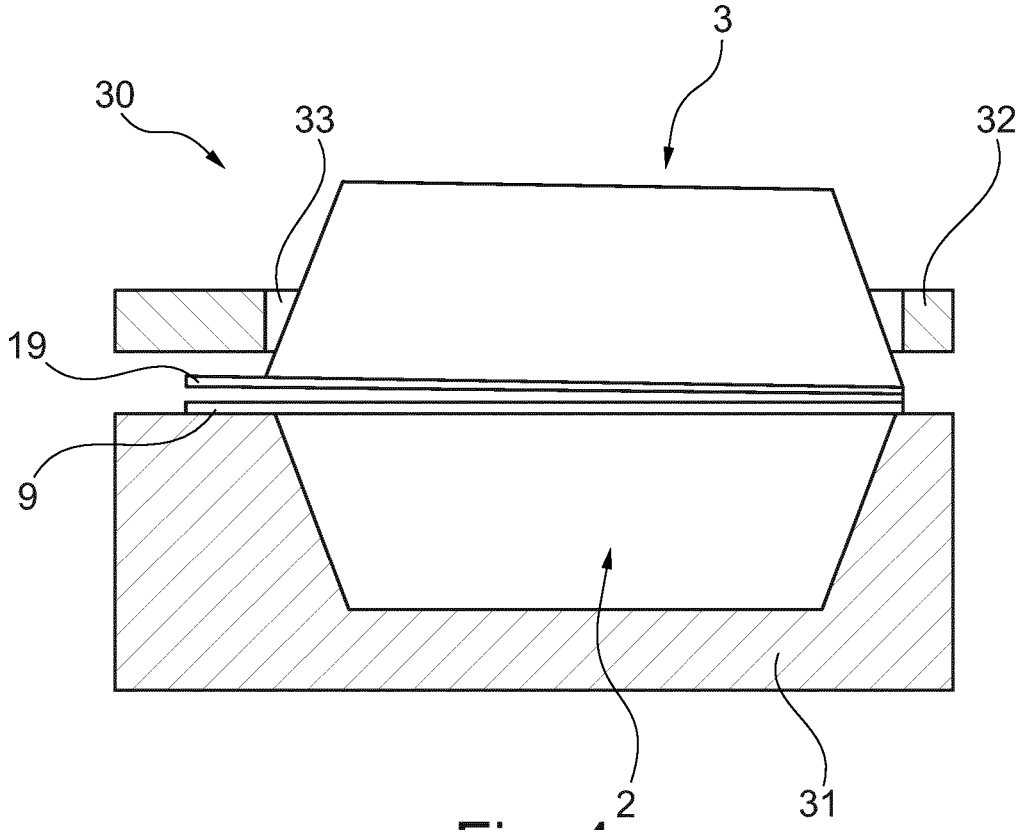
FIG. 4 shows schematically a cross sectional view of a device for sealing a clamshell packaging according to FIG. 3.

FIG. 4 shows schematically a cross sectional view of a device for sealing a clamshell packaging 30 according to FIG. 3. The device has a mold 31 with a recess in which the first pool part 2 is accommodated. A heated frame 32 is arranged above the mold 31 and can be pressed on top of the mold 31 to clamp the flange 9, 19 and seal the foil of the seal zone together to close the packaging 30.

The frame 32 has an opening 33, which corresponds with the second pool part 3, such that it can extend through the frame 32.

Figure 5A:
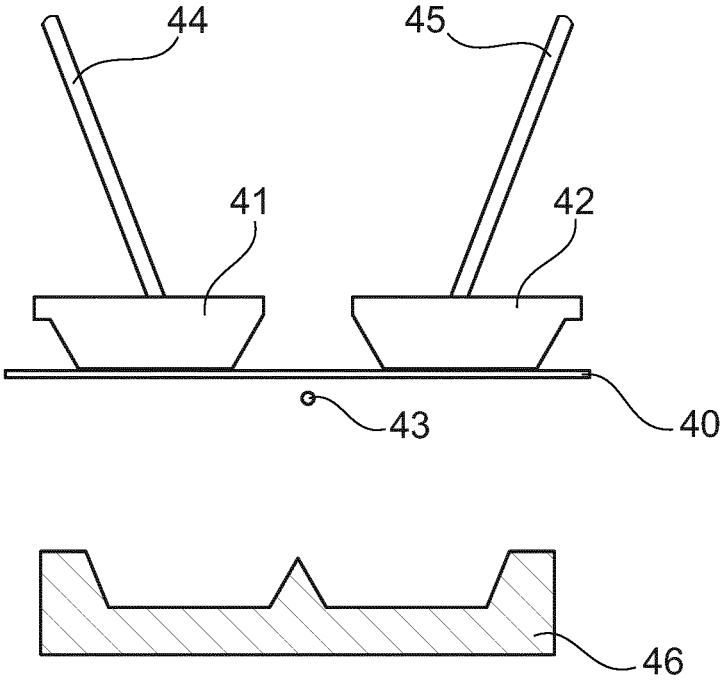
FIG. 5A shows schematic steps of a first embodiment of a method according to the invention.
Figure 5B:
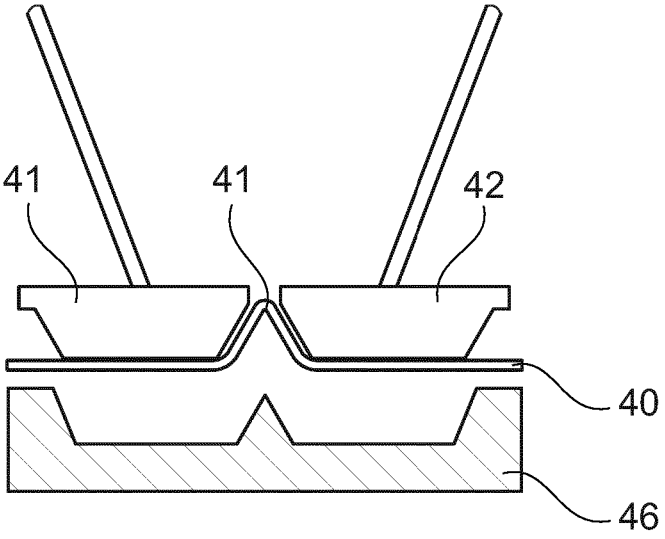
FIG. 5B shows schematic steps of a first embodiment of a method according to the invention.

FIGS. 5A and 5B show schematic steps of a first embodiment of a method according to the invention. As shown in FIG. 5A, an unfolded sheet 40 is provided, similar to the sheet of FIG. 1. A removable pin 43 is provided between the shape blocks 41, 42. The shape blocks 41, 42 are guided along guides 44, 45, such that when the shape blocks 41, 42 are pushed towards the mold 46, the sheet 40 is brought into contact with the removable pin 43, such that the hinge line 47 is folded into the sheet 40, while the shape blocks 41, 42 move towards each other.

The removable pin 43 is then removed, such that the prefolded sheet 40 can be pushed further into the mold 46 to fully fold the sheet 40 into a tray as shown in FIG. 2. (See FIG. 5B)

Figure 6A:
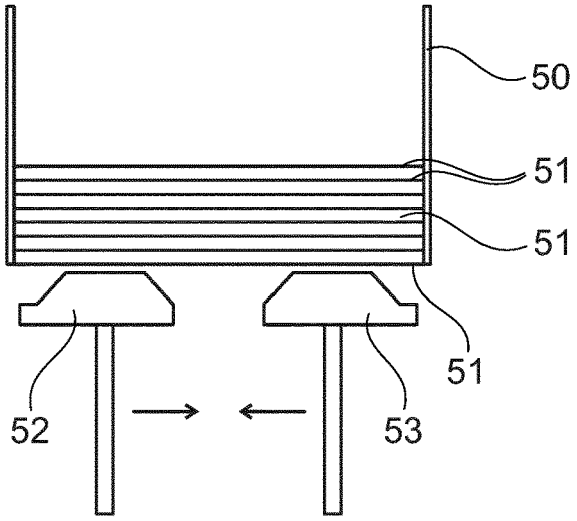
FIG. 6A shows schematic steps of a second embodiment of a method according to the invention.

FIG. 6A shows schematic steps of a second embodiment of a method according to the invention. A storage 50 with a number of stacked, unfolded sheets 51 is provided.

Figure 6B:
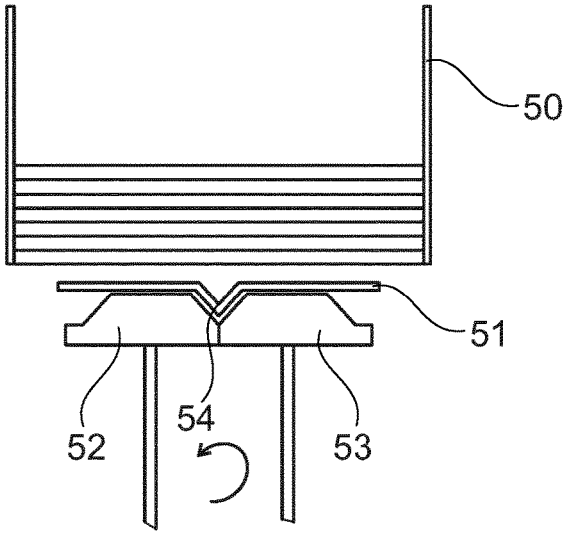
FIG. 6B shows schematic steps of a second embodiment of a method according to the invention.
Figure 6C:
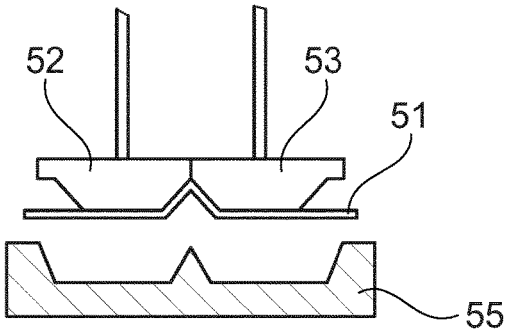
FIG. 6C shows schematic steps of a second embodiment of a method according to the invention.

Two shape blocks 52, 53 grab the bottom sheet 51 and then move towards each other to pre-fold the sheet 52. As shown in FIG. 6B, the pre-folded sheet 51 has a hinge line 54 when the two shape blocks 52, 53 are in contact with each other.

Then the shape blocks 52, 53 are rotated such that the pre-folded sheet 51 can be pressed further into a mold 55 to fully fold the sheet 52 into a tray as shown in FIG. 2.

Figure 7:
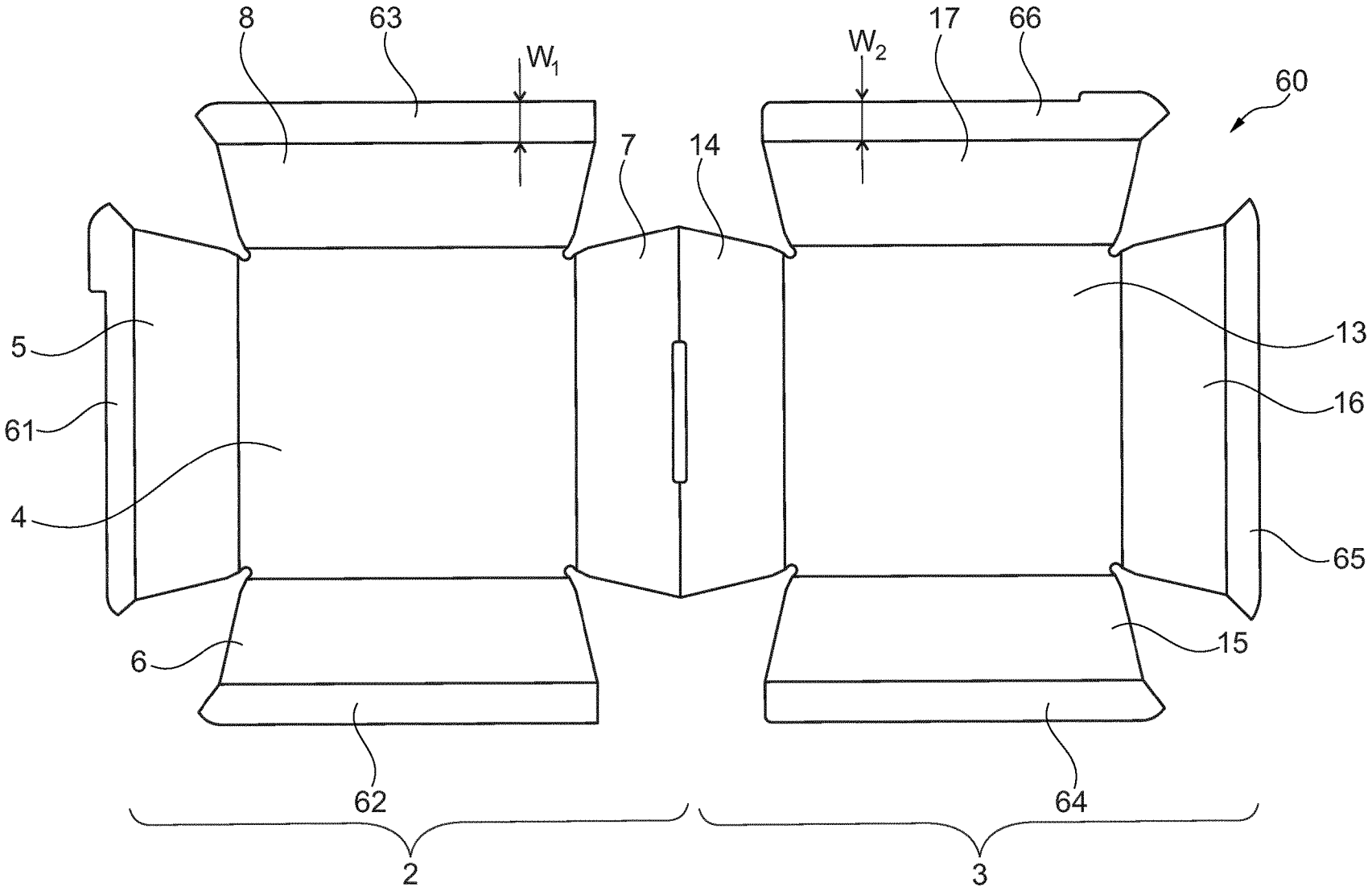
FIG. 7 shows a top view of an unfolded sheet for a second embodiment of a clamshell packaging according to the invention.

FIG. 7 shows a top view of an unfolded sheet 60 for a second embodiment of a clamshell packaging according to the invention. The unfolded sheet 60 is similar to the unfolded sheet 1 of FIG. 1 and similar parts are identified with the same reference number.

The first pool part 2 has a bottom wall 4 with upstanding walls 5, 6, 7, 8 to which flange parts 61, 62, 63 are arranged. The second pool part 3 has a bottom wall 13 with upstanding walls 14, 15, 16, 17 to which flange parts 64, 65, 66 are arranged.

The flange parts 61, 62, 63 of the first pool part 2 have a width $w_1$, while the flange parts 64, 65, 66 of the second pool part 3 have a width $w_2$. Because the width $w_2$ is larger than the width $w_1$, the flanges 64, 65, 66 will cover the flanges 61, 62, 63, when the two pool parts 2, 3 are folded on top of each other.

The feature of the differing width of the flange parts can also be used on other embodiments of the invention including the embodiment 1 shown in FIGS. 1-3.

Figure 8:
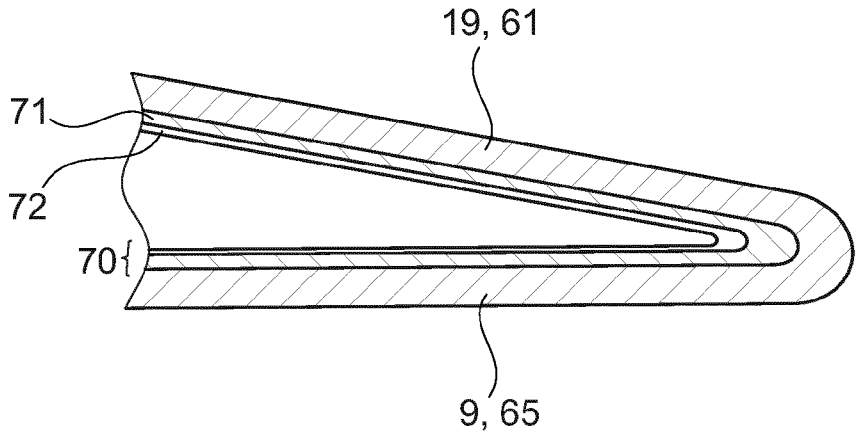
FIG. 8 shows a cross-sectional view along the flanges of the embodiments shown in FIGS. 1-3 and 7.

FIG. 8 shows a cross-sectional view along the flanges 19, 61 and 9, 65 of either embodiment 1 or 60 of the packaging according to the invention.

A plastic barrier foil 70 is arranged on the flanges 9, 19, 61, 65, which has a skin foil 71 in direct contact with the flanges 9, 19, 61, 65 and a release medium layer 72. When the two pool parts 2, 3 are folded on top of each other, the release medium layer 72 will be folded on top of it self and can be laminated. The release medium layer 72 ensures that after sealing the packaging closed, it can still easily be opened.

The above embodiments are merely preferred embodiments of the present disclosure. It should be set forth that, for a person skilled in the art, improvements and modifications may be made, with such improvements and modifications being deemed to be within the protection and scope of the present disclosure without departing away from the principles of the present disclosure.

The invention claimed is:

1. A clamshell packaging for airtight packaging of foodstuff, the packaging comprising:

a tray folded out of a single sheet of material, the tray having at least two adjacent pool parts, each pool part having a bottom wall and upstanding walls arranged around the perimeter edge of the bottom wall;

a circumferential, horizontal flange arranged to the tray to at least some upper edges of the upstanding walls; and a plastic barrier foil arranged in the at least two adjacent pool parts and extending onto and substantially covering the circumferential, horizontal flange, wherein the at least two adjacent pool parts are hingedly connected to each other along an upper edge of a respective upstanding wall, such that the at least two adjacent pool parts can be hinged on top of each other to form a closed box, wherein the circumferential, horizontal flange comprises a seal zone extending along the full length of the flange, wherein the seal zone is line symmetrical along a hinge line at the upper edge of the connected walls, and wherein the circumferential, horizontal flange is composed out of a number of abutting flange parts, each flange part being arranged to a respective upper edge of an upstanding wall, and wherein each transition of two abutting edges of the number of abutting flange parts are positioned asymmetrically along the hinge line, such that none of the transitions overlap with each other when the at least two adjacent pool parts are hinged on top of each other.

2. The clamshell packaging according to claim 1, wherein the circumferential, horizontal flange is provided with two tabs, each tab arranged on opposite sides of the hinge line and line asymmetrically along the hinge line.

3. The clamshell packaging according to claim 2, wherein the difference in distance to the hinge line of the two tabs is at least equal to half of the combined length of the two tabs.

4. The clamshell packaging according to claim 2, wherein the two tabs are arranged on opposite sides of the hinge line and line asymmetrically along the hinge line and on the same side of the tray.

5. The clamshell packaging according to claim 2, wherein the plastic barrier foil is a laminate of at least a skin foil layer and a release medium layer, wherein the skin foil layer is in direct contact with the tray.

6. The clamshell packaging according to claim 2, wherein the tray is provided with a slot arranged in the upstanding walls along the hinge line.

7. The clamshell packaging according to claim 1, wherein the plastic barrier foil is a laminate of at least a skin foil layer and a release medium layer, wherein the skin foil layer is in direct contact with the tray.

8. The clamshell packaging according to claim 1, wherein the tray is provided with a slot arranged in the upstanding walls along the hinge line.

9. The clamshell packaging according to claim 1, wherein the circumferential, horizontal flange is wider adjacent to a first pool part than adjacent to a second pool part.

10. A device for sealing a clamshell packaging according to claim 1, wherein the at least two adjacent pool parts are hinged on top of each other to form a closed box, the device comprising:

a mold for accommodating a first pool part of the tray with the horizontal circumferential flange on the upper surface of the mold;

a heated frame movable on top of the upper surface, wherein inner dimensions of the heated frame correspond to inner dimensions of the horizontal, circumferential flange, such that a second pool part can extend through the heated frame, while the horizontal, circumferential flange is clamped between the mold and the frame to seal the seal zone together.

11. A method for providing a clamshell packaging according to claim 1, the method comprising the steps of:

providing an unfolded sheet for folding the tray;

providing a mold having at least two recesses;

folding the unfolded sheet to the tray by pressing the unfolded sheet into the mold, accommodating the at least two pool parts in a recess of the mold, and composing a horizontal, circumferential flange out of a number of flange parts, each flange part being arranged to a respective upper edge of the upstanding walls of the at least two pool parts, which flange parts compose an endless circumferential flange, and wherein adjacent wall parts and adjacent flange parts of the at least two pool parts abut;

providing a plastic barrier foil;

heating the plastic barrier foil;

pressing the heated plastic barrier foil against the inner wall of the at least two pool parts and covering the circumferential flange, such that the plastic barrier foil is laminated to the tray.

12. The method according to claim 11, wherein the bottom walls of the pool parts are pushed towards each other, while pressing the unfolded sheet into the mold.

13. The method according to claim 12, further providing two shape blocks each to act at least on a bottom wall of a respective pool part to shape the unfolded sheet while pressing the unfolded sheet into the mold.

14. The method according to claim 13, wherein the two shape blocks are each guided along a guide arranged under an angle with the top surface of the mold, such that the two shape blocks move towards each other, while being moved into the mold to fold the unfolded sheet.

15. The method according to claim 13, wherein the two shape blocks are guided along a first guide parallel to the top surface of the mold and are guided along a second guide perpendicular to the top surface of the mold, wherein the shape blocks first move along the first guide to fold the connected wall parts of both pool parts and then the shape blocks move along the second guide to fold the sheet into the mold.

16. The clamshell packaging according to claim 1, wherein the tray comprises cardboard.

17. The clamshell packaging according to claim 1, wherein the plastic barrier foil is a laminate of at least a skin foil layer and a release medium layer, wherein the skin foil layer is in direct contact with the tray.

18. The clamshell packaging according to claim 1, wherein the tray is provided with a slot arranged in the upstanding walls along the hinge line.

19. The clamshell packaging according to claim 1, wherein the circumferential, horizontal flange is wider adjacent to a first pool part than adjacent to a second pool part.

* * * * *